US011223122B2

(12) United States Patent
Hasegawa et al.

(10) Patent No.: US 11,223,122 B2
(45) Date of Patent: Jan. 11, 2022

(54) ANTENNA

(71) Applicant: FUJIKURA LTD., Tokyo (JP)

(72) Inventors: Yuta Hasegawa, Sakura (JP); Ning Guan, Sakura (JP)

(73) Assignee: FUJIKURA LTD., Tokyo (JP)

( * ) Notice: Subject to any disclaimer, the term of this patent is extended or adjusted under 35 U.S.C. 154(b) by 0 days.

(21) Appl. No.: 16/954,616

(22) PCT Filed: Oct. 5, 2018

(86) PCT No.: PCT/JP2018/037375
§ 371 (c)(1),
(2) Date: Jun. 17, 2020

(87) PCT Pub. No.: WO2019/142409
PCT Pub. Date: Jul. 25, 2019

(65) Prior Publication Data

US 2020/0335860 A1 Oct. 22, 2020

(30) Foreign Application Priority Data

Jan. 19, 2018 (JP) ..... JP2018-006892

(51) Int. Cl.
*H01Q 1/38* (2006.01)
*H01Q 1/40* (2006.01)
(Continued)

(52) U.S. Cl.
CPC ..... *H01Q 1/38* (2013.01); *H01Q 1/40* (2013.01); *H01Q 13/08* (2013.01); *H01Q 21/065* (2013.01)

(58) Field of Classification Search
CPC ..... H01Q 1/38; H01Q 1/40; H01Q 13/08; H01Q 21/065; H01Q 1/005; H01Q 13/206
See application file for complete search history.

(56) References Cited

U.S. PATENT DOCUMENTS

2005/0235482 A1 10/2005 Deaett et al.
2010/0090902 A1 4/2010 Thompson et al.
(Continued)

FOREIGN PATENT DOCUMENTS

EP 2579695 A1 4/2013
JP 56-73903 A 6/1981
(Continued)

OTHER PUBLICATIONS

International Search Report dated Dec. 11, 2018, issued in counterpart application No. PCT/JP2018/037375 , w/English translation (5 pages).

*Primary Examiner* — David E Lotter
(74) *Attorney, Agent, or Firm* — Westerman, Hattori, Daniels & Adrian, LLP

(57) ABSTRACT

To stabilize radiation characteristics of a radiation element by reducing bending deformation of the radiation element and widen a band of an antenna. An antenna includes: a first flexible dielectric layer; a conductive pattern layer formed on a surface of the first dielectric layer; a second flexible dielectric layer joined to the first dielectric layer on a side opposite to the conductive pattern layer with respect to the first dielectric layer; a conductive ground layer formed between the first dielectric layer and the second dielectric layer; a rigid dielectric substrate joined to the second dielectric layer on a side opposite to the conductive ground layer with respect to the second dielectric layer; and an antenna pattern layer formed between the second dielectric layer and the dielectric substrate and including one or more radiation elements, the conductive pattern layer including a feed line for supplying electric power to the radiation elements.

10 Claims, 15 Drawing Sheets

(51) Int. Cl.
*H01Q 13/08* (2006.01)
*H01Q 21/06* (2006.01)

(56) References Cited

U.S. PATENT DOCUMENTS

| | | | | |
|---|---|---|---|---|
| 2017/0279177 | A1 | 9/2017 | Oguri et al. | |
| 2019/0020114 | A1* | 1/2019 | Paulotto | H01Q 9/0442 |
| 2020/0028251 | A1* | 1/2020 | Shimura | H05K 1/028 |

FOREIGN PATENT DOCUMENTS

| | | | |
|---|---|---|---|
| JP | 2-107003 | A | 4/1990 |
| JP | 5-145327 | A | 6/1993 |
| JP | 6-29723 | A | 2/1994 |
| JP | 9-107226 | A | 4/1997 |
| JP | 2010-114826 | A | 5/2010 |

* cited by examiner

ANTENNA

TECHNICAL FIELD

The present disclosure relates to an antenna.

BACKGROUND ART

In recent years, the usable band and frequency of a transmission signal have been rapidly widen and risen, with a rapid increase in wireless communication capacity. This has been widening the usable frequency from a microwave band of 0.3 to 30 GHz to a millimeter wave band of 30 to 300 GHz. In a band of 60 GHz, although a transmission signal is greatly attenuated in the air, there are advantages as follows. The first advantage is that communication data are less likely to leak. The second advantage is that it is possible to dispose multiple communication cells by reducing the size of communication cells. The third advantage is that a communication band is a broad band, which enables large-capacity communication. These advantages draw attention to the band of 60 GHz. However, since a transmission signal is greatly attenuated, a broadband antenna having high directivity and gain has been demanded. In particular, an array antenna including a plurality of radiation elements arranged at short pitches has been actively researched.

Patent Literature 1 discloses an antenna in which a dielectric layer is joined to a conductive ground layer, a plurality of radiation elements and microstrip feed lines are formed, and dielectric layers for space impedance conversion coat the radiation elements and the microstrip feed lines.

CITATION LIST

Patent Literature

[Patent Literature 1] Japanese Patent Application Publication No. H6-29723

SUMMARY OF INVENTION

Technical Problem

To transmit a signal wave using the microstrip feed lines, the dielectric layer needs to be sufficiently thin with respect to a wavelength. The thin dielectric layer is flexible, which causes bending deformation. In association therewith, bending deformation of the radiation elements also occur, and this changes radiation characteristics of the radiation elements. Further, such a thin dielectric layer narrows a band of an antenna.

Thus, the present disclosure has been achieved in view of the circumstances described above. An object of the present disclosure is to stabilize radiation characteristics of a radiation element by reducing bending deformation of the radiation element and to widen a band of an antenna.

Solution to Problem

A primary aspect of the present disclosure to achieve the aforementioned object is an antenna comprising: a first dielectric layer; a conductive pattern layer formed on a surface of the first dielectric layer; a second dielectric layer joined to the first dielectric layer on a side opposite to the conductive pattern layer with respect to the first dielectric layer; a conductive ground layer formed between the first dielectric layer and the second dielectric layer; a dielectric substrate joined to the second dielectric layer on a side opposite to the conductive ground layer with respect to the second dielectric layer; and an antenna pattern layer formed between the second dielectric layer and the dielectric substrate, the antenna pattern layer including one or more radiation elements, the conductive pattern layer including a feed line for supplying electric power to the radiation elements, the first and second dielectric layers being flexible, the dielectric substrate being rigid.

Other features of the present disclosure are made clear from the following description and the drawings.

Advantageous Effects of Invention

According to the present disclosure, bending deformation of a radiation element can be reduced, and radiation characteristics of the radiation element are stabilized and less likely to change.

It is possible to reduce losses in the feed line and the radiation element by making first and second dielectric layers thin, while a band of an antenna can be suppressed from being narrowed by disposing a dielectric substrate on the radiation element.

DESCRIPTION OF EMBODIMENTS

Figure 1:
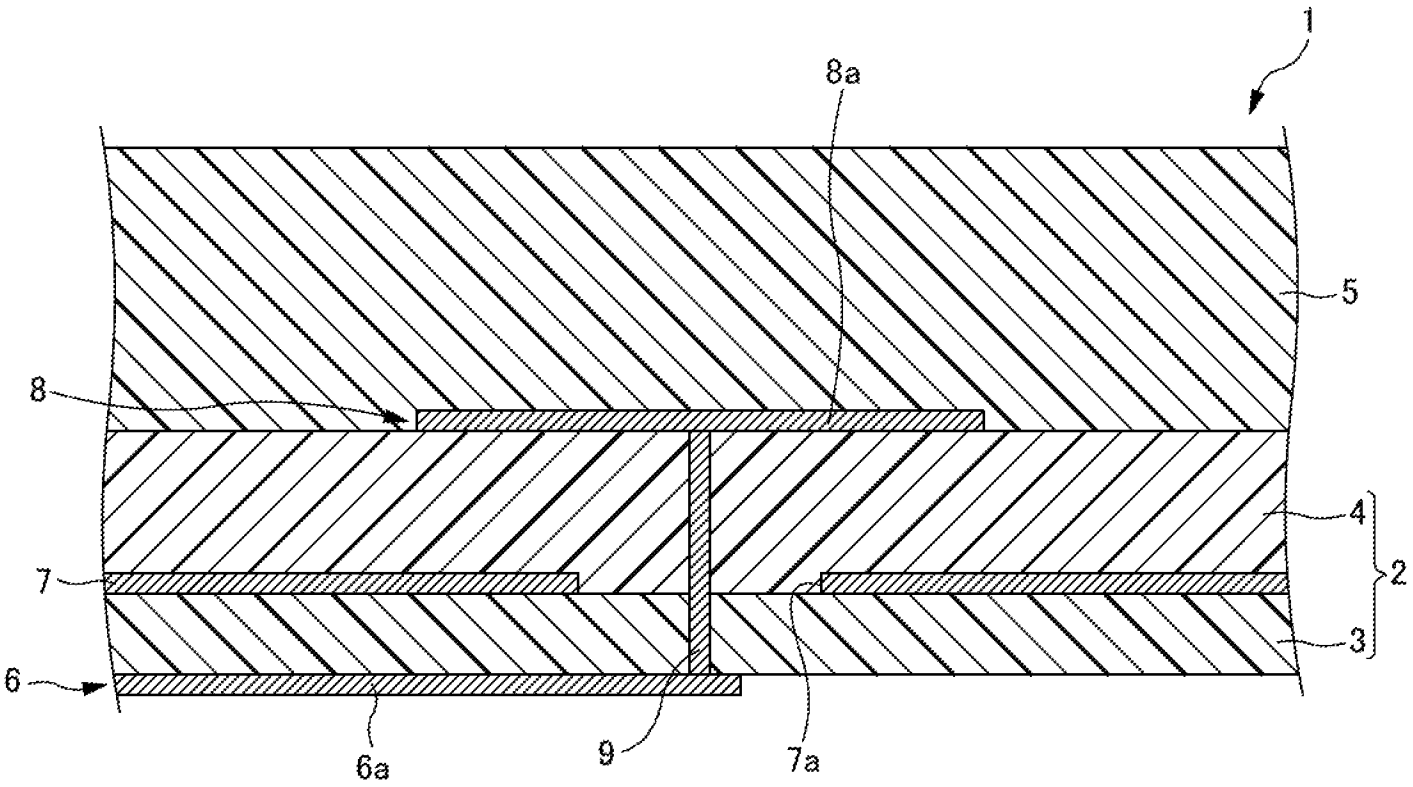
FIG. 1 is a cross-sectional view of an antenna according to a first embodiment.

At least the following matters are made clear from the following description and the drawings.

An antenna comprising: a first dielectric layer; a conductive pattern layer formed on a surface of the first dielectric layer; a second dielectric layer joined to the first dielectric layer on a side opposite to the conductive pattern layer with respect to the first dielectric layer; a conductive ground layer formed between the first dielectric layer and the second dielectric layer; a dielectric substrate joined to the second dielectric layer on a side opposite to the conductive ground layer with respect to the second dielectric layer; and an antenna pattern layer formed between the second dielectric layer and the dielectric substrate, the antenna pattern layer including one or more radiation elements, the conductive pattern layer including a feed line for supplying electric power to the radiation elements, the first and second dielectric layers being flexible, the dielectric substrate being rigid.

As described above, even when the first and second dielectric layers are flexible, the dielectric substrate is rigid, and thus bending deformation of the radiation elements can be reduced. For this reason, the radiation characteristics of the radiation elements are stabilized and less likely to change.

Since the dielectric substrate is rigid, the first and second dielectric layers can be made thin. By making the first dielectric layer thin, a radiation loss of a signal wave in the feed line can be suppressed. By virtue of the dielectric substrate on the radiation elements, the antenna has a low quality factor and a wide band. Even if the second dielectric substrate is thin, a band of the antenna is suppressed from being narrowed.

A thickness of the dielectric substrate is 300 to 700 μm.

Accordingly, the directivity in a normal direction of a surface of the dielectric substrate is high, and a gain in the normal direction is high.

A sum of thicknesses of the first and second dielectric layers is equal to or less than 250 μm.

Four, six, or eight of the radiation elements are linearly arranged at intervals and connected in series, and electric power is supplied through the feed line to the center of a row of the radiation elements.

Accordingly, an improvement in gain of the antenna can be achieved.

Two rows of the radiation elements are linearly arranged in line, and one of the radiation element rows has a shape that is line symmetric or point symmetric with a shape of another of the radiation element rows, or has a shape obtained by moving the other radiation element row in parallel.

Accordingly, an improvement in gain of the antenna can be achieved.

A plurality of the radiation element rows are arranged at a predetermined pitch in a direction orthogonal to a direction of the radiation element rows, and radiation elements positioned in the same order in the radiation element rows are arranged in line in the orthogonal direction.

Accordingly, an improvement in gain of the antenna can be achieved.

The predetermined pitch is 2 to 2.5 mm.

A plurality of groups are provided, the groups each including the plurality of radiation element rows arranged at the predetermined pitch in the direction orthogonal to the direction of the radiation element rows, and directions of the radiation element rows in all of the groups are parallel to each other.

The antenna further comprises an adhesive layer of a dielectric formed between the second dielectric layer and the dielectric substrate so as to coat the radiation elements, to bond the second dielectric layer and the dielectric substrate together, wherein the adhesive layer is thicker than the radiation elements and thinner than the dielectric substrate.

Accordingly, a void is less likely to be created around the radiation elements at a bonding interface between the adhesive layer and the second dielectric layer. The adhesive layer does not greatly affect radiation characteristics of the radiation element as compared to the dielectric substrate.

The second dielectric layer is a laminate obtained by laminating a plurality of dielectric layers.

Accordingly, a multilayer wiring structure can be formed outside a range in which the radiation elements are formed.

Embodiments

Embodiments of the present disclosure are described below with reference to the drawings. Note that, although various limitations that are technically preferable for carrying out the present disclosure are imposed on the embodiments to be described below, the scope of the present disclosure is not to be limited to the embodiments below and illustrated examples.

First Embodiment

FIG. 1 is a cross-sectional view of an antenna 1 according to a first embodiment. The antenna 1 is used for transmission or reception of a radio wave in a frequency band of a microwave or millimeter wave, or both of the transmission and reception.

A first dielectric layer 3 and a second dielectric layer 4 sandwich a conductive ground layer 7 therebetween and are joined to each other, thereby constituting a flexible dielectric laminate 2.

The conductive ground layer 7 is formed between the first dielectric layer 3 and the second dielectric layer 4.

A conductive pattern layer 6 is formed on a surface of the first dielectric layer 3 on a side opposite to the conductive ground layer 7 with respect to the first dielectric layer 3.

The dielectric laminate 2 and a dielectric substrate 5 sandwich an antenna pattern layer 8 therebetween and are joined to each other. The antenna pattern layer 8 is formed between the dielectric laminate 2 and the dielectric substrate 5. In other words, the antenna pattern layer 8 is formed on a surface of the second dielectric layer 4 on a side opposite to the conductive ground layer 7 with respect to the second dielectric layer 4.

As described above, the conductive pattern layer 6, the first dielectric layer 3, the conductive ground layer 7, the second dielectric layer 4, the antenna pattern layer 8, and the dielectric substrate 5 are laminated in this order.

The conductive pattern layer 6, the conductive ground layer 7, and the antenna pattern layer 8 are made of a conductive metal material such as copper.

The antenna pattern layer 8 is processed and shaped by an additive method, a subtractive method, or the like, thereby forming a patch-type radiation element 8*a* in the antenna pattern layer 8.

The conductive ground layer 7 is processed and shaped by an additive method, a subtractive method, or the like, thereby forming a slot 7*a* in the conductive ground layer 7. The slot 7*a* faces a central part of the radiation element 8*a*.

The conductive pattern layer 6 is processed and shaped by an additive method, a subtractive method, or the like, thereby forming a feed line 6*a* in the conductive pattern layer 6. The feed line 6*a* is a microstrip line arranged from a terminal of a radio frequency integrated circuit (RFIC) to a position facing the slot 7*a*. One end part of the feed line 6*a* faces the slot 7*a*, and the one end part is electrically connected to the radiation element 8*a* by a through hole 9. The other end part of the feed line 6*a* is connected to the terminal of the RFIC. Thus, electric power is supplied to the radiation element 8*a* from the RFIC via the feed line 6*a* and the through hole 9.

The through hole 9 penetrates the conductive ground layer 7 through the slot 7*a*. The through hole 9 is insulated from the conductive ground layer 7.

The dielectric layers 3 and 4 are made of a liquid crystal polymer. The dielectric substrate 5 is made of fiber-reinforced resin, and more specifically, glass fiber-reinforced epoxy resin, glass-cloth base epoxy resin, glass-cloth base polyphenylene ether resin, or the like.

The sum of the thickness of the first dielectric layer 3 and the thickness of the second dielectric layer 4 is thinner than the thickness of the dielectric substrate 5. In particular, the sum of the thickness of the first dielectric layer 3 and the thickness of the second dielectric layer 4 is equal to or less than 250 μm.

Since the thickness of the dielectric substrate 5 falls within a range of 300 to 700 μm, the gain of the antenna 1 is high, leading to high directivity in a normal direction of a surface of the dielectric substrate 5.

The dielectric layers 3 and 4 are flexible, and the dielectric substrate 5 is rigid. In other words, flex resistance of the dielectric layers 3 and 4 is sufficiently higher than flex resistance of the dielectric substrate 5, and an elastic modulus of the dielectric substrate 5 is sufficiently greater than an elastic modulus of the dielectric layers 3 and 4. Thus, a laminate formed of the conductive pattern layer 6, the first dielectric layer 3, the conductive ground layer 7, the second dielectric layer 4, the antenna pattern layer 8, and the dielectric substrate 5 is less likely to be bent. In particular, a change in radiation characteristics of the radiation element 8*a* caused by bending deformation of the radiation element 8*a* is less likely to occur.

The first dielectric layer 3 is thin, the first dielectric layer 3 has a low dielectric constant and dielectric loss tangent, and the feed line 6*a* is exposed to the air, and thus a transmission loss of a signal wave in the feed line 6*a* is low. Further, an electric field is mainly formed between the radiation element 8*a* and the conductive ground layer 7, and the second dielectric layer 4 has a low dielectric constant and dielectric loss tangent, and thus a loss in the radiation element 8*a* is low even though the radiation element 8*a* is covered with the dielectric substrate 5. Accordingly, the antenna 1 has a low Q factor and a wide band. Further, the dielectric substrate 5 is not necessary to be thin, thereby suppressing the band of the antenna 1 from being narrowed. Note that Q factor is also referred to as Quality factor.

When the dielectric substrate 5 is formed of glass-cloth base epoxy resin (particularly, FR4), a bending elastic modulus in a vertical direction is 24.3 GPa, a bending elastic modulus in a lateral direction is 20.0 GPa, a dielectric constant is 4.6, and a dielectric loss tangent is 0.050. Here, the bending elastic moduluses in the vertical direction and the lateral direction are measured by a test method based on a standard of ASTM D 790, and the dielectric constant and the dielectric loss tangent are measured by a test method (frequency: 3 GHz) based on a standard of ASTM D 150.

When the dielectric substrate 5 is made of a glass-cloth base polyphenylene ether resin (particularly, Megtron (registered trademark) 6) manufactured by Panasonic Corporation, a bending elastic modulus in the lateral direction is 18 GPa, a relative dielectric constant (Dk) is 3.4, and a dielectric loss tangent (Df) is 0.0015. Here, the bending elastic modulus in the lateral direction is measured by a test method based on a standard of JIS C 6481, and the relative dielectric constant and the dielectric loss tangent are measured by a test method (frequency: 1 GHz) based on a standard of IPC TM-650 2.5.5.9.

On the other hand, when the dielectric layers 3 and 4 are made of a liquid crystal polymer, a bending elastic modulus is 12152 MPa, a dielectric constant is 3.56, and a dielectric loss tangent is 0.0068. Here, the bending elastic modulus is measured by a test method based on a standard of ASTM D 790, and the dielectric constant and the dielectric loss tangent are measured by a test method (frequency: $10^3$ Hz) based on a standard of ASTM D 150.

Modification Examples of First Embodiment

Next, some modifications from the above-described embodiment will be described. Some modifications described below may be combined as much as possible.

Figure 2:
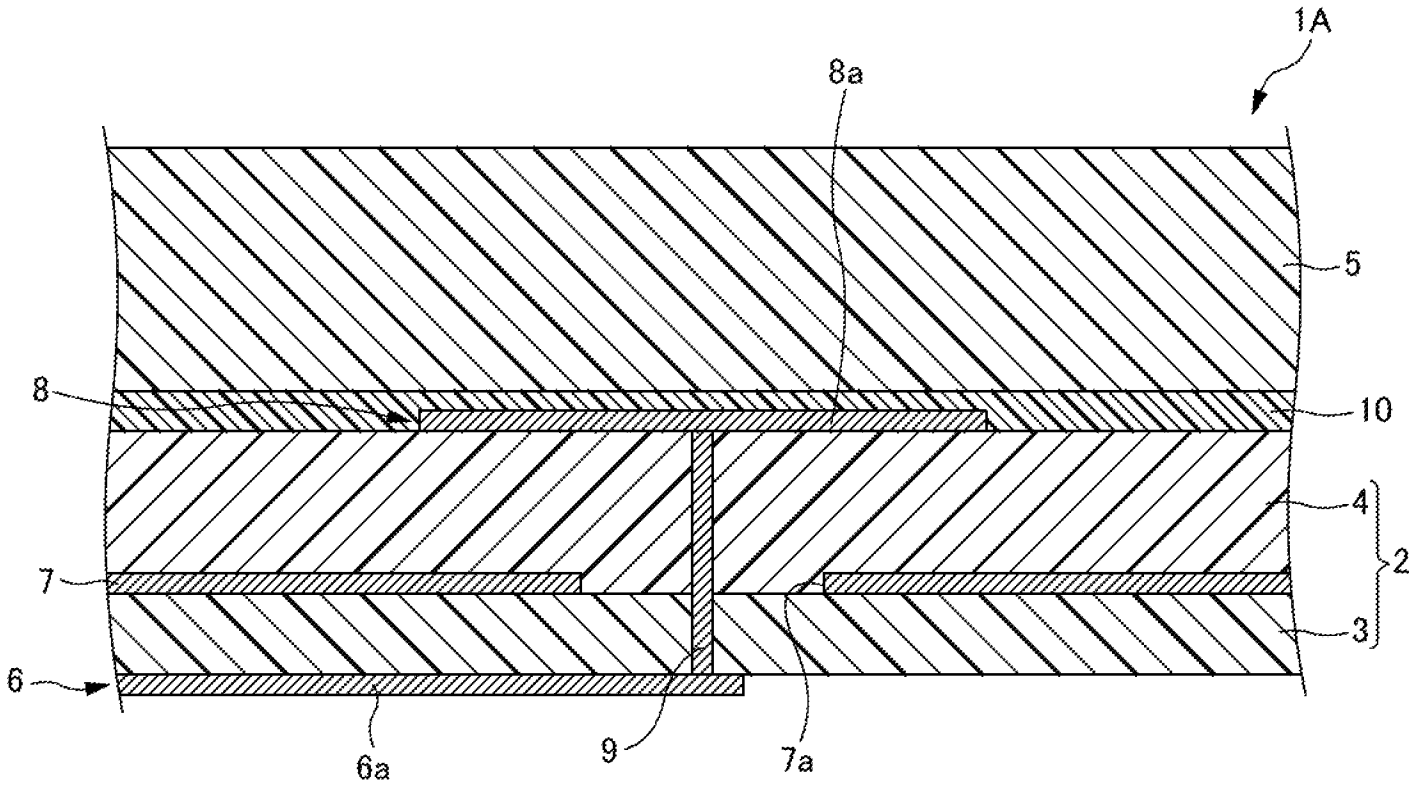
FIG. 2 is a cross-sectional view of an antenna according to a first modification example of a first embodiment.

(1) As in an antenna 1A in a modification example illustrated in FIG. 2, the dielectric laminate 2 and the dielectric substrate 5 may be bonded together with an adhesive layer 10 of a dielectric. The adhesive layer 10 is formed on the surface of the second dielectric layer 4 so as to coat the radiation element 8*a*, and the second dielectric layer 4 and the dielectric substrate 5 are bonded together with the adhesive layer 10. The adhesive layer 10 facilitates bonding between the second dielectric layer 4 and the dielectric substrate 5.

Since the adhesive layer 10 is thicker than the radiation element 8*a*, a void is less likely to be created around the radiation element 8*a* at a bonding interface between the adhesive layer 10 and the second dielectric layer 4.

The adhesive layer 10 is thinner than the dielectric substrate 5, and particularly the thickness of the adhesive layer 10 is equal to or less than 1/10 of the thickness of the dielectric substrate 5. Thus, the adhesive layer 10 does not greatly affect the radiation characteristics of the radiation element 8*a* as compared to the dielectric substrate 5.

Note that, when the thickness of the dielectric substrate 5 is 300 to 700 μm and the thickness of the radiation element 8*a* is approximately 12 μm, the thickness of the adhesive layer 10 is preferably 15 to 50 μm.

Figure 3:
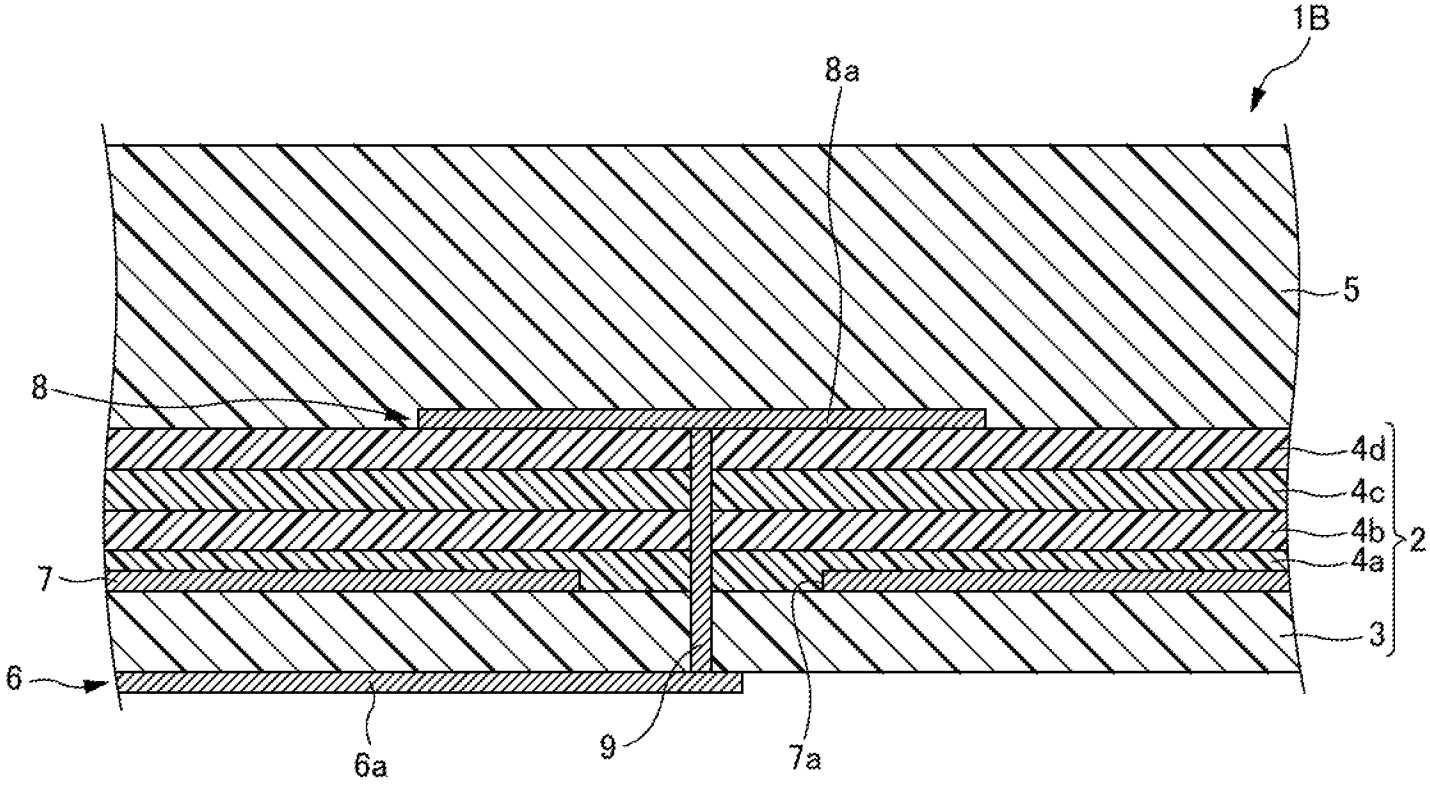
FIG. 3 is a cross-sectional view of an antenna according to a second modification example of a first embodiment.

(2) As in an antenna 1B in a modification example illustrated in FIG. 3, the second dielectric layer 4 may be a laminate of flexible dielectric layers 4*a* to 4*d*. The dielectric layers 4*b* and 4*d* are made of a liquid crystal polymer, and the dielectric layers 4*a* and 4*c* are formed of an adhesive material. The dielectric layers 4*a* to 4*d* are laminated in this order. The dielectric layer 4*a* is formed on the surface of the first dielectric layer 3 so as to coat the conductive ground layer 7, and the dielectric layer 4*b* and the first dielectric layer 3 are bonded together with the dielectric layer 4*a*. The dielectric layer 4*b* and the dielectric layer 4*d* are bonded together with the dielectric layer 4*c*. The antenna pattern layer 8 is formed on the surface of the second dielectric layer 4, that is, the surface of the dielectric layer 4*d*.

Since the second dielectric layer 4 is a laminate of the dielectric layers 4*a* to 4*d*, a multilayer wiring structure can be formed in the second dielectric layer 4 in a region in which the radiation element 8*a* is not formed, that is, outside the range illustrated in FIG. 3.

Figure 4:
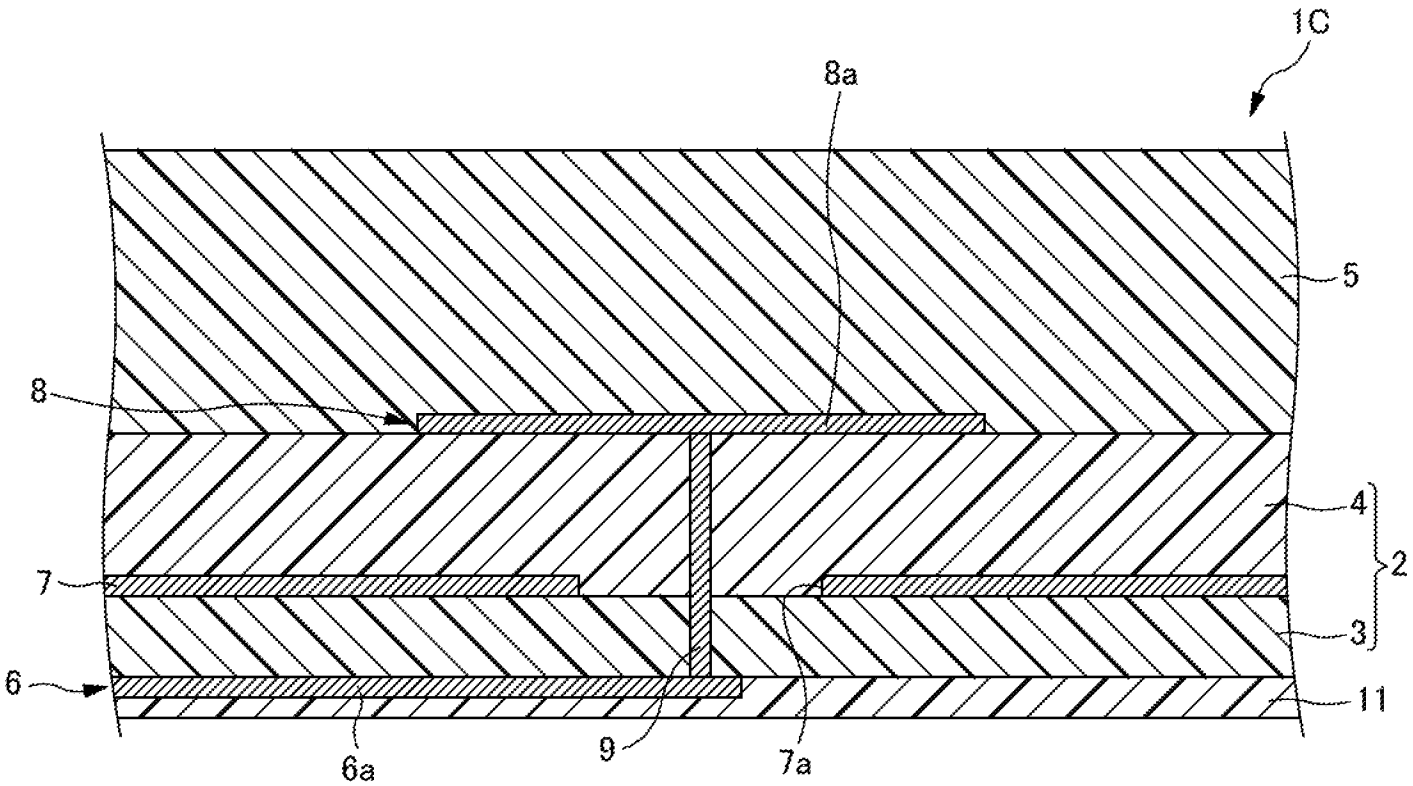
FIG. 4 is a cross-sectional view of an antenna according to a third modification example of a first embodiment.

(3) As in an antenna 1C in a modification example illustrated in FIG. 4, a protective dielectric layer 11 may be formed on the surface of the dielectric laminate 2, that is, the surface of the first dielectric layer 3, so as to coat the conductive pattern layer 6. The conductive pattern layer 6 is protected by the protective dielectric layer 11.

Figure 5:
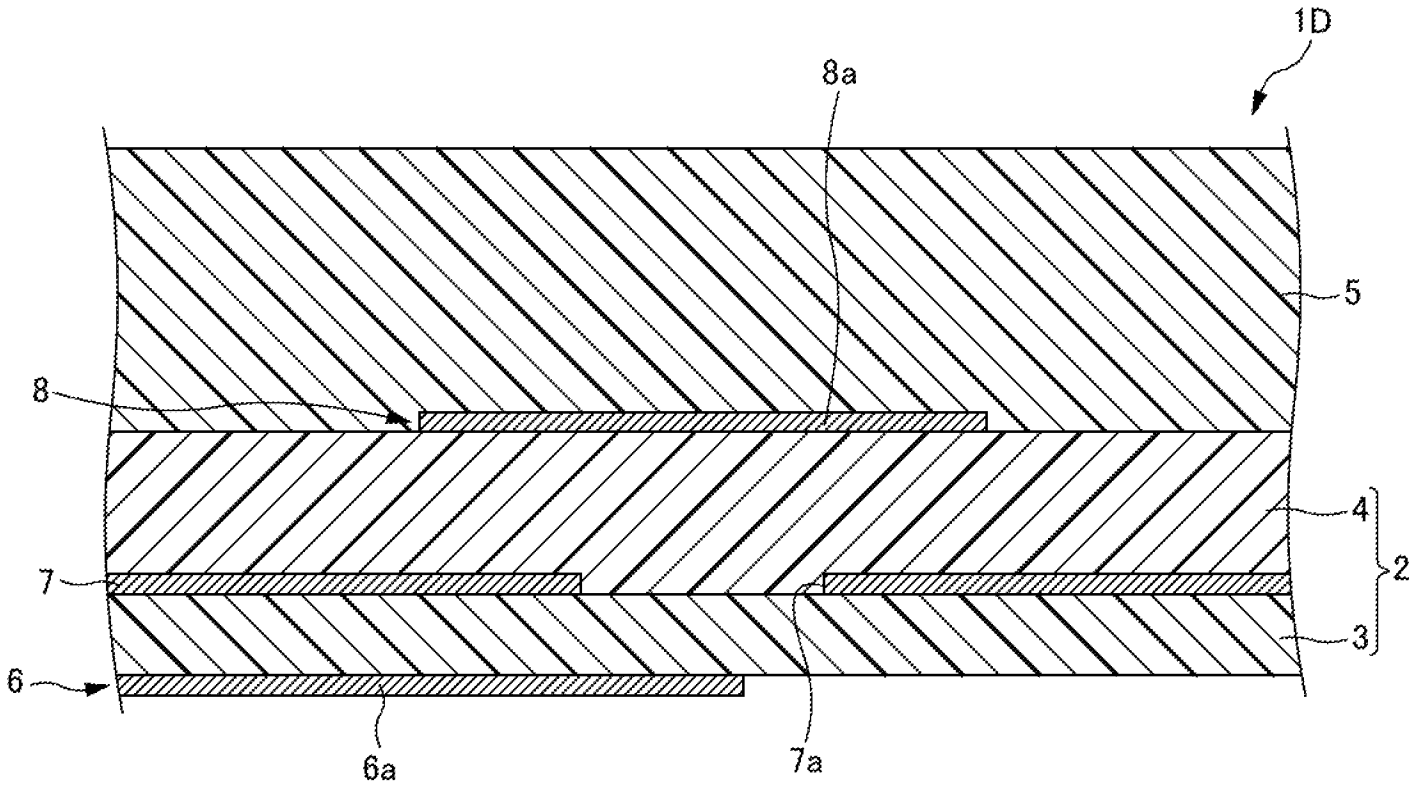
FIG. 5 is a cross-sectional view of an antenna according to a fourth modification example of a first embodiment.

(4) As in an antenna 1D in a modification example illustrated in FIG. 5, one end part of the feed line 6*a* may be electromagnetically coupled to the radiation element 8*a* through the slot 7*a*, without forming a through hole in the dielectric layers 3 and 4.

Second Embodiment

Figure 6:
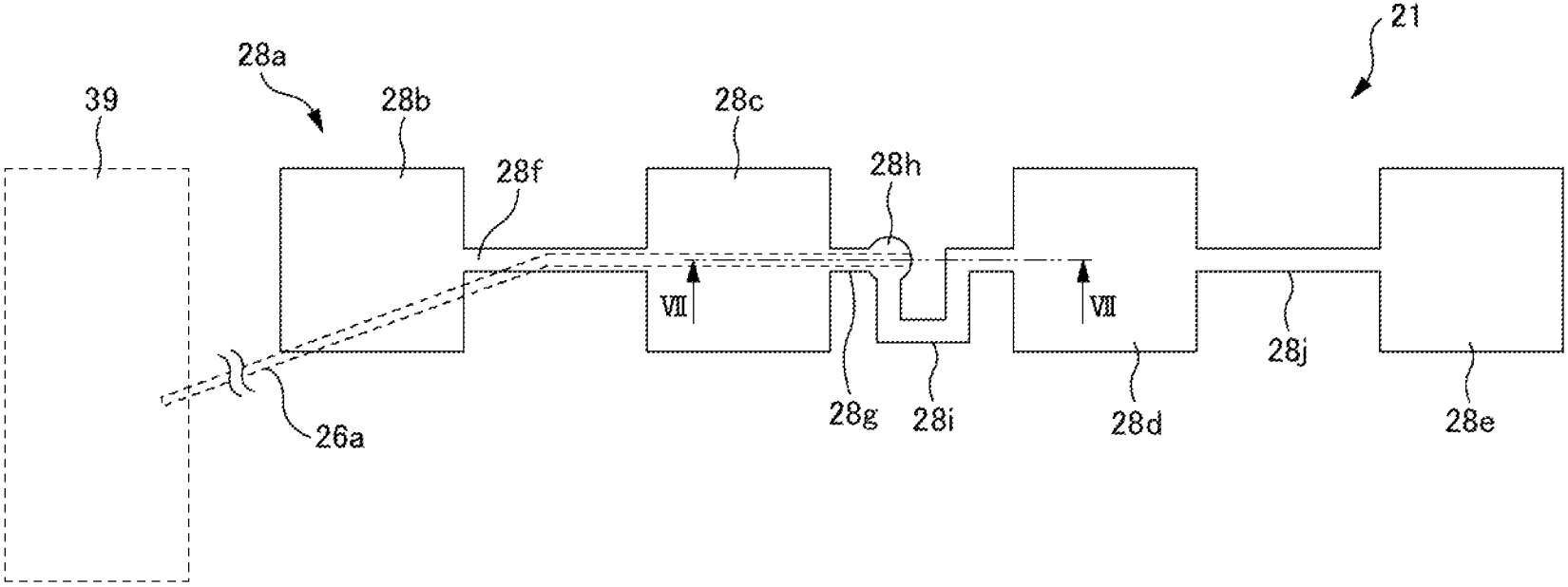
FIG. 6 is a plan view of an antenna according to a second embodiment.
Figure 7:
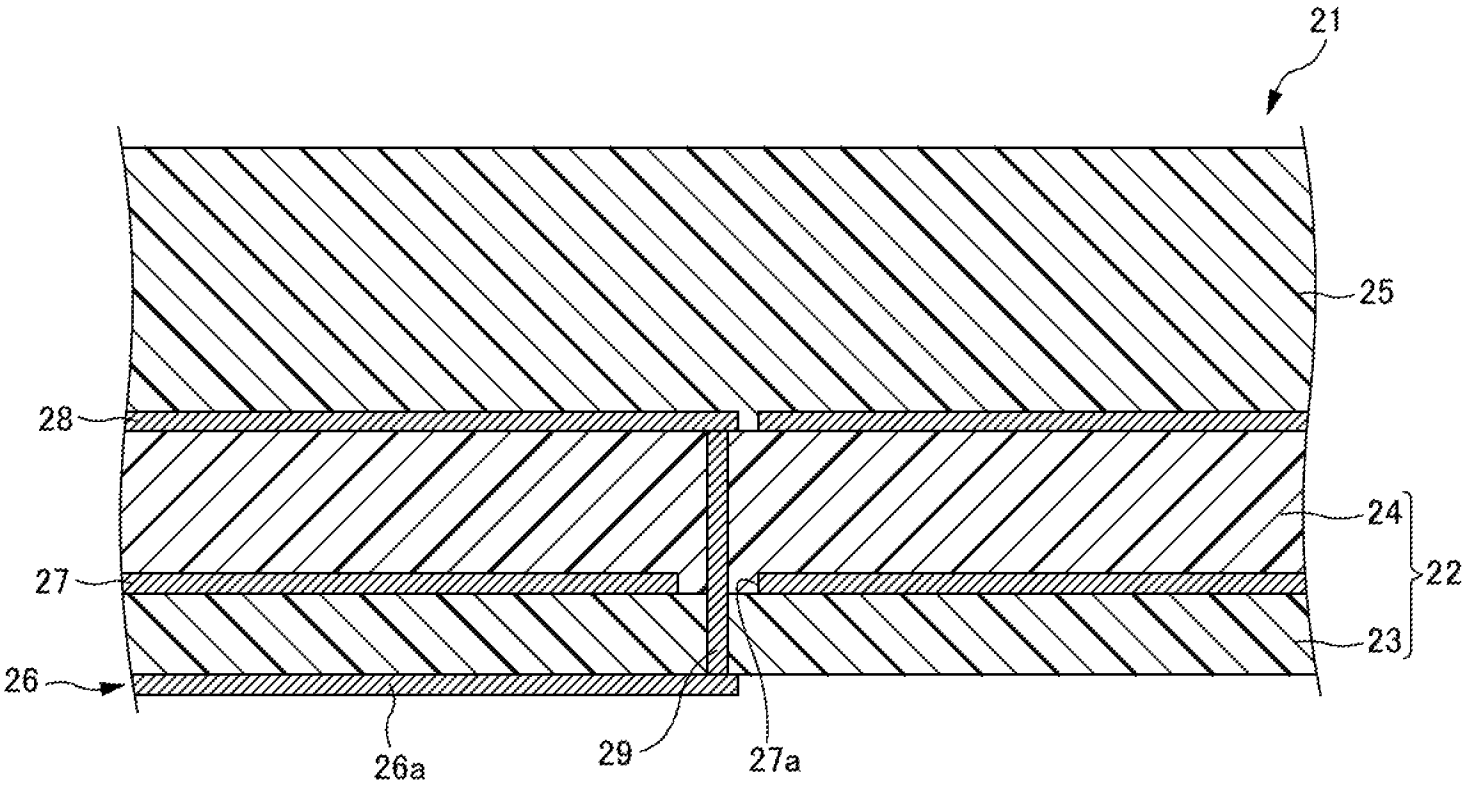
FIG. 7 is a cross-sectional view of a cut place taken along VII-VII of FIG. 6.

FIG. 6 is a plan view of an antenna 21 according to a second embodiment. FIG. 7 is a cross-sectional view taken along a line VII-VII of FIG. 6. The antenna 21 is used for transmission or reception of a radio wave in a frequency band of a microwave or millimeter wave, or both of the transmission and reception.

A flexible first dielectric layer 23 and a flexible second dielectric layer 24 sandwich a conductive ground layer 27 having conductivity therebetween and are joined to each other, thereby constituting a flexible dielectric laminate 22.

The conductive ground layer 27 is formed between the first dielectric layer 23 and the second dielectric layer 24.

A conductive pattern layer 26 is formed on a surface of the first dielectric layer 23 on a side opposite to the conductive ground layer 27 with respect to the first dielectric layer 23.

The second dielectric layer 24 and a rigid dielectric substrate 25 sandwich an antenna pattern layer 28 therebetween and are joined to each other. The antenna pattern layer 28 is formed between the second dielectric layer 24 and the dielectric substrate 25.

As described above, the conductive pattern layer 26, the first dielectric layer 23, the conductive ground layer 27, the second dielectric layer 24, the antenna pattern layer 28, and the dielectric substrate 25 are laminated in this order.

An RFIC 39 is mounted on the surface of the first dielectric layer 23 on a side opposite to the conductive ground layer 27 with respect to the first dielectric layer 23.

The composition and thickness of the first dielectric layer 23 are the same as the composition and thickness of the first dielectric layer 3 in the first embodiment. The composition and thickness of the second dielectric layer 24 are the same as the composition and thickness of the second dielectric layer 4 in the first embodiment. The composition and thickness of the dielectric substrate 25 are the same as the composition and thickness of the dielectric substrate 5 in the first embodiment. The composition and thickness of the conductive pattern layer 26 are the same as the composition and thickness of the conductive pattern layer 6 in the first embodiment. The composition and thickness of the conductive ground layer 27 are the same as the composition and thickness of the conductive ground layer 7 in the first embodiment. The composition and thickness of the antenna pattern layer 28 are the same as the composition and thickness of the antenna pattern layer 8 in the first embodiment.

The antenna pattern layer 28 is processed and shaped by an additive method, a subtractive method, or the like, thereby forming an element row 28*a* in the antenna pattern layer 28. The element row 28*a* includes patch-type radiation elements 28*b* to 28*e*, feed lines 28*f*, 28*g*, 28*i*, and 28*j*, and a land part 28*h*.

The radiation elements 28*b* to 28*e* are linearly arranged in a row in this order at intervals. Here, the radiation element 28*b* in the element row 28*a* is set at a leading end, and the radiation element 28*e* is set at a tail end.

The radiation elements 28*b* to 28*e* are connected in series as follows.

The leading-end radiation element 28*b* and the second radiation element 28*c* are connected in series using the feed line 28*f* provided therebetween. The land part 28*h* is provided at the center of the element row 28*a*, that is, between the second radiation element 28*c* and the third radiation element 28*d*. The second radiation element 28*c* and the land part 28*h* are connected in series using the feed line 28*g* provided therebetween. The third radiation element 28*d* and the land part 28*h* are connected in series using the feed line 28*i* provided therebetween. The third radiation element 28*d* and the tail-end radiation element 28*e* are connected in series using the feed line 28*j* provided therebetween. The feed lines 28*f*, 28*g*, and 28*j* are formed linearly, and the feed line 28*i* is bent. The length of the feed line 28*g* is smaller than the length of the feed lines 28*f*, 28*i*, and 28*j*.

Since the element row 28*a* includes the four radiation elements 28*b* to 28*e*, the gain of the antenna 21 is high.

The conductive ground layer 27 is processed and shaped by an additive method, a subtractive method, or the like, thereby forming a slot 27*a* in the conductive ground layer 27. The slot 27*a* faces the center of the element row 28*a*, that is, the land part 28*h*.

The conductive pattern layer 26 is processed and shaped by an additive method, a subtractive method, or the like, thereby forming a feed line 26*a* in the conductive pattern layer 26. The feed line 26*a* is a microstrip line arranged from a terminal of the RFIC 39 to a position facing the slot 27*a*. One end part of the feed line 26*a* faces the slot 27*a*, and the one end part is electrically connected to the land part 28*h* by a through hole 29. The other end part of the feed line 26*a* is connected to the terminal of the RFIC 39. Thus, electric power is supplied to the element row 28*a* from the RFIC 39 via the feed line 26*a* and the through hole 29. The through hole 29 penetrates the conductive ground layer 27 through the slot 27*a*. The through hole 29 is insulated from the conductive ground layer 27.

Figure 8:
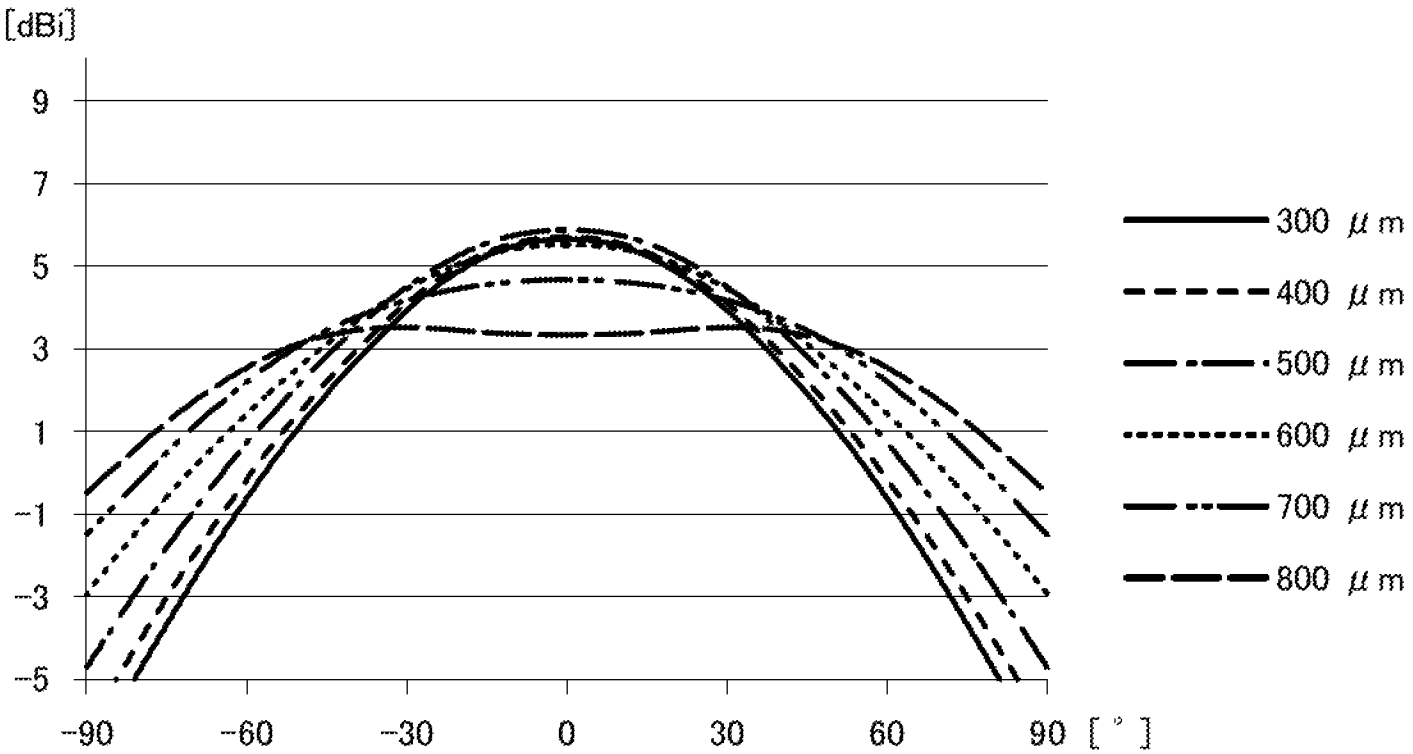
FIG. 8 is a graph illustrating a simulation result of a gain of an antenna according to a second embodiment.

Since the thickness of the dielectric substrate 25 falls within a range of 300 to 700 μm, the gain of the antenna 21 is high, leading to high directivity in a normal direction of a surface of the dielectric substrate 25. FIG. 8 illustrates a result of verifying this. The gain of the antenna 21 when the thickness of the dielectric substrate 25 is 300 μm, 400 μm, 500 μm, 600 μm, 700 μm, and 800 μm is simulated. In FIG. 8, a lateral axis indicates an angle relative to the normal direction of the surface of the dielectric substrate 25, and a vertical axis indicates a gain. When the thickness of the dielectric substrate 25 is 300 μm, 400 μm, 500 μm, 600 μm, and 700 μm, the directivity in the normal direction is high, and all the gains in the normal direction in a range of −30° to 30° are high exceeding 4 dBi. When the thickness of the dielectric substrate 25 is 800 μm, the directivity in the normal direction is low, and gains in the normal direction at all the angles are under 4 dBi. Thus, it is clear that the gain of the antenna 21 and the directivity in the normal direction of the surface of the dielectric substrate 25 is high as long as the thickness of the dielectric substrate 25 falls within a range of 300 to 700 μm.

Since the dielectric substrate 25 is rigid, a laminate formed of the conductive pattern layer 26, the first dielectric layer 23, the conductive ground layer 27, the second dielectric layer 24, the antenna pattern layer 28, and the dielectric substrate 25 is less likely to be bent. In particular, a change in radiation characteristics of the element row 28*a* caused by bending deformation of the element row 28*a* is less likely to occur.

The first dielectric layer 23 is thin, the first dielectric layer 23 has a low dielectric constant and dielectric loss tangent, and the feed line 26*a* is exposed to the air, and thus a transmission loss of a signal wave in the feed line 26*a* is low. Further, an electric field is formed mainly between the element row 28*a* and the conductive ground layer 27, and the second dielectric layer 24 has a low dielectric constant and dielectric loss tangent, and thus a loss in the element row 28*a* is low even through the element row 28*a* is covered with the dielectric substrate 25. Accordingly, the antenna 21 has a low Q factor and a wide band. Further, the dielectric substrate 25 is not necessary to be thin, which suppresses the band of the antenna 21 from being narrowed.

Figure 9:
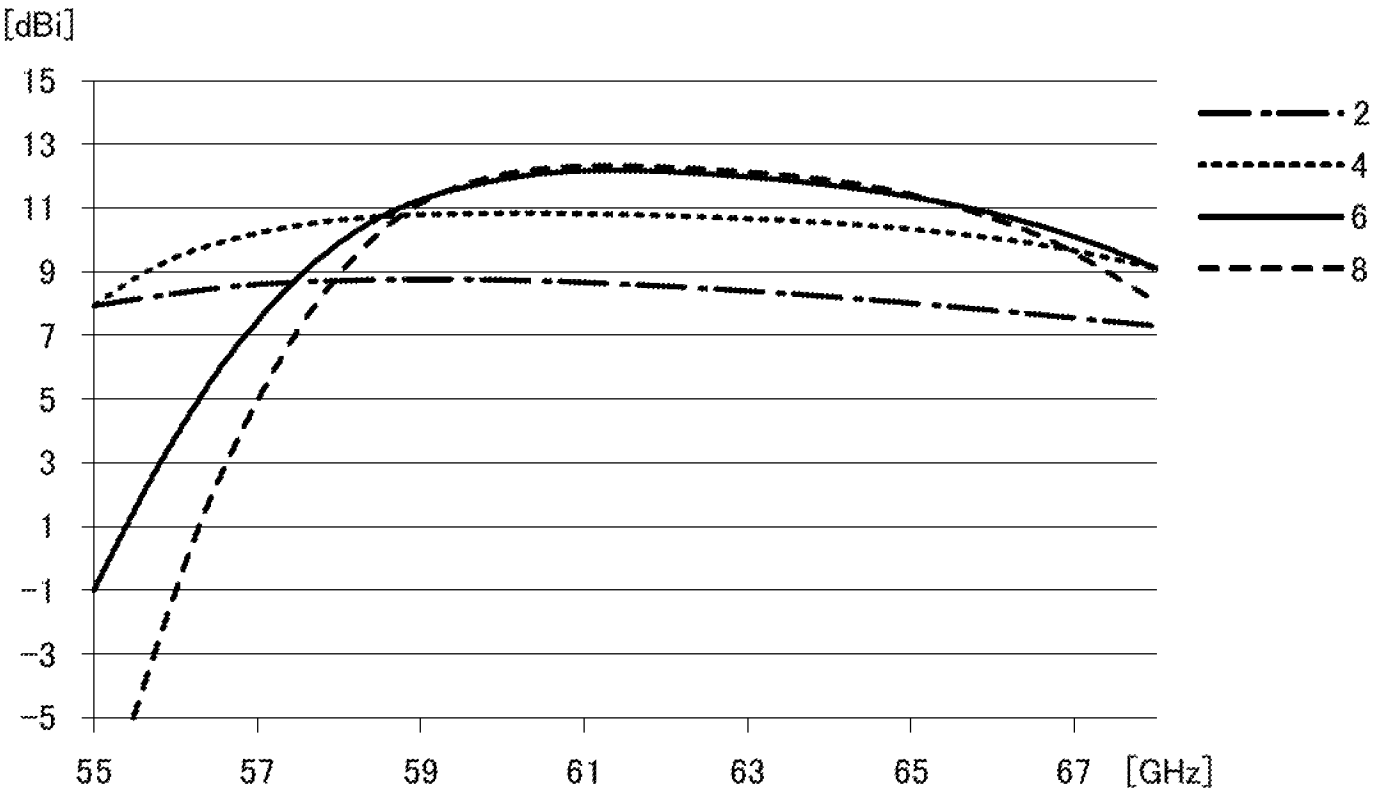
FIG. 9 is a graph illustrating a simulation result of a gain of an antenna according to a second embodiment.

The element row 28*a* is a series-connection body of the four radiation elements 28*b* to 28*e*, but the number of radiation elements is not limited thereto as long as the number is an even number. However, the element row 28*a* preferably includes four, six, or eight radiation elements. FIG. 9 illustrates a result of verifying this. The gain of the antenna 21 when the number of elements in the element row 28*a* is two, four, six, and eight is simulated. In FIG. 9, a lateral axis indicates a frequency, and a vertical axis indicates a gain. When the number of elements in the element row 28*a* is four, six, or eight, a frequency band in which a gain exceeds 9 dBi is wide in a range of 58 to 67 GHz. When the number of elements in the element row 28*a* is two, a gain does not exceed 9 dBi in a frequency band in a range of 56 to 68 GHz. Thus, it is clear that the number of elements in the element row 28*a* is preferably four, six, and eight.

Modification Examples of Second Embodiment

The modifications in the first embodiment may be applied to the second embodiment as in (1) to (4) below.

(1) The dielectric laminate 22 and the dielectric substrate 25 may be bonded together with an adhesive layer of a dielectric.

(2) The second dielectric layer 24 may be a laminate of a plurality of flexible dielectric layers.

(3) A protective dielectric layer may be formed on the surface of the first dielectric layer 23 so as to coat the conductive pattern layer 26.

(4) One end part of the feed line 26*a* may be electromagnetically coupled to the land part 28*h* through the slot 27*a*, without forming a through hole in the dielectric layers 23 and 24.

Figure 10:
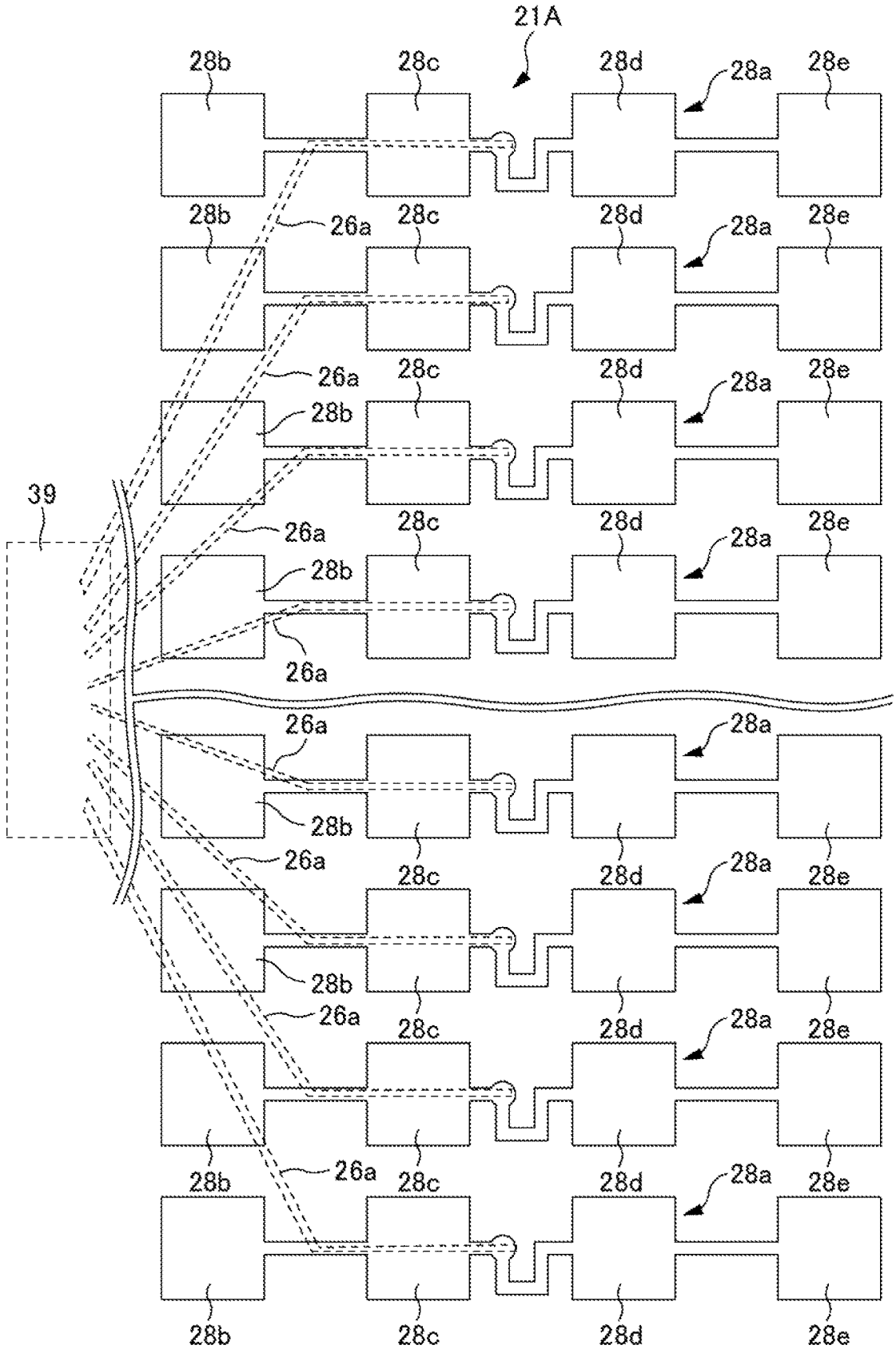
FIG. 10 is a plan view of an antenna according to a first modification example of a second embodiment.

As in an antenna 21A in a modification example illustrated in a plan view of FIG. 10, a plurality of sets (e.g., 16 sets) each including the element row 28*a*, the feed line 26*a*, the slot 27*a* (see. FIG. 7), and the through hole 29 (see. FIG. 7) may be arranged, at predetermined pitches, in a direction orthogonal to the row direction of the element row 28*a*. In this case, the positions in the row direction of the radiation elements 28*b* in the respective element rows 28*a* are aligned, and the radiation elements 28*b* are arranged in line in the direction orthogonal to the row direction. The same applies to the radiation elements 28*c* of the respective element rows 28*a*. The same applies to the radiation elements 28*d* of the respective element rows 28*a*. The same applies to the radiation elements 28*e* of the respective element rows 28*a*.

A pitch between the element rows 28*a* adjacent to each other, that is, an interval between the central lines thereof in the row direction is 2 to 2.5 mm. Since the plurality of radiation elements 28*b* to 28*e* are arranged in a grid pattern in such a manner, a high gain is achieved.

Figure 11:
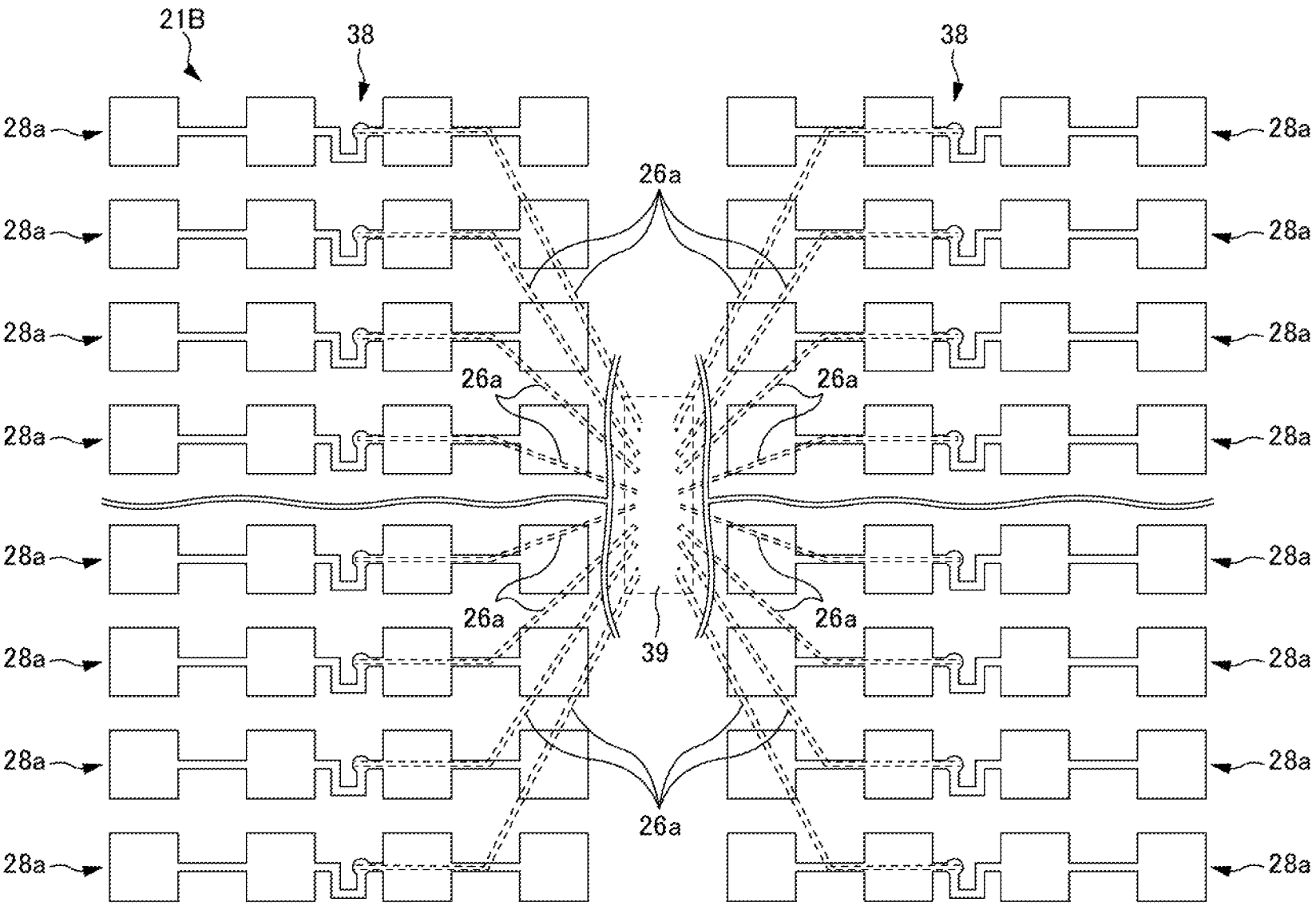
FIG. 11 is a plan view of an antenna according to a second modification example of a second embodiment.

As in an antenna 21B of a modification example illustrated in a plan view of FIG. 11, two groups 38 may be provided, each of which includes a plurality of sets (e.g., 16 sets) each including the element row 28*a*, the feed line 26*a*, the slot 27*a* (see. FIG. 7), and the through hole 29 (see. FIG. 7). In this case, in both of the groups 38, the positions in the row direction of the radiation elements 28*b* in the respective element rows 28*a* are aligned, and the radiation elements 28*b* are arranged in line in the direction orthogonal to the row direction. The same applies to the radiation elements 28*c* of the respective element rows 28*a*. The same applies to the radiation elements 28*d* of the respective element rows 28*a*. The same applies to the radiation elements 28*e* of the respective element rows 28*a*.

In both of the groups 38, a pitch between the element rows 28*a* adjacent to each other, that is, an interval between the central lines thereof in the row direction is 2 to 2.5 mm. The row direction of the element row 28*a* in one of the groups 38 is parallel to the row direction of the element row 28*a* in the other of the groups 38. The RFIC 39 is disposed between the one and the other groups 38. The one group 38 is used for reception, and the other group 38 is used for transmission. Since the plurality of radiation elements 28*b* to 28*e* are arranged in a grid pattern in both of the groups 38, a high gain is achieved. Note that both of the groups 38 may be used for reception or may be used for transmission.

Note that three or more groups 38 may be provided. In this case, the row directions of the element rows 28*a* in all of the groups 38 are parallel to each other. Alternatively, when four groups 38 are provided, the first group 38 and the second group 38 are laterally arranged in the paper plane of FIG. 11 as in FIG. 11, the third group 38 and the fourth group 38 are vertically arranged in the paper plane of FIG. 11, the RFIC 39 is disposed between the first group 38 and the second group 38, the RFIC 39 is disposed between the third group 38 and the fourth group 38, the row direction of the element row 28*a* of the first group 38 is parallel to the row direction of the element row 28*a* of the second group 38, and the row direction of the element row 28*a* of the third and fourth groups 38 is vertical to the row direction of the element row 28*a* of the first and second groups 38.

Third Embodiment

Figure 12:
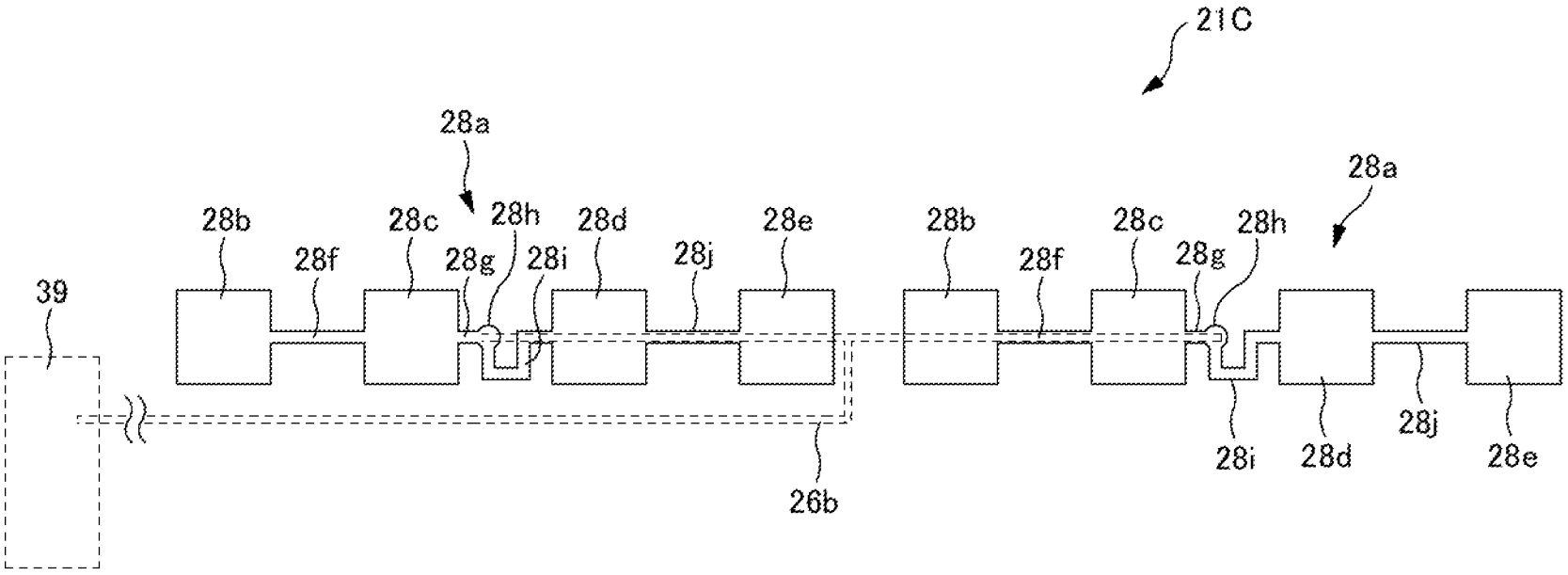
FIG. 12 is a plan view of an antenna according to a third embodiment.

FIG. 12 is a plan view of an antenna 21C according to a third embodiment. Hereinafter, differences between the antenna 21C in the third embodiment and the antenna 21 in the second embodiment will be described, and description of common points will be omitted.

In the antenna 21 in the second embodiment, the antenna pattern layer 28 includes one element row 28*a*. In contrast, in the antenna 21C in the third embodiment, an antenna pattern layer 28 is processed and shaped by an additive method, a subtractive method, or the like, and thus the antenna pattern layer 28 includes two element rows 28*a*.

One of the element rows 28*a* has a shape obtained by moving the other of the element rows 28*a* in parallel in the row direction. Radiation elements 28*b* to 28*e* in the other element row 28*a* are linearly arranged in line at intervals in the order of the radiation elements 28*b*, 28*c*, 28*d*, and 28*e*, following a tail-end radiation element 28*e* in the one element row 28*a*. Accordingly, the radiation elements 28*b* to 28*e* in these element rows 28*a* are linearly arranged.

A conductive pattern layer 26 is processed and shaped by an additive method, a subtractive method, or the like, and the conductive pattern layer 26 includes a T-branch feed line 26*b*. The feed line 26*b* branches into two from an RFIC 39 to land parts 28*h* in the two element rows 28*a*, and two branched end parts face the land parts 28*h* in the two element rows 28*a*, respectively. Then, similarly to the second embodiment, slots 27*a* are respectively formed in parts of a conductive ground layer 27 facing the two branched end parts of the feed line 26*b*, and the two branched end parts of the feed line 26*b* are electrically connected to the land parts 28*h* in the two element rows 28*a*, respectively, by through holes 29 penetrating dielectric layers 23 and 24. Note that the two branched end parts of the feed line 26*b* may be electromagnetically coupled to the land parts 28*h* in the two element rows 28*a*, respectively, through the respective slots 27*a*.

An electrical length from a terminal of the RFIC 39 to the land part 28*h* in the one element row 28*a* along the feed line 26*b* is equal to an electrical length from the terminal of the RFIC 39 to the land part 28*h* in the other element row 28*a* along the feed line 26*b*.

Fourth Embodiment

Figure 13:
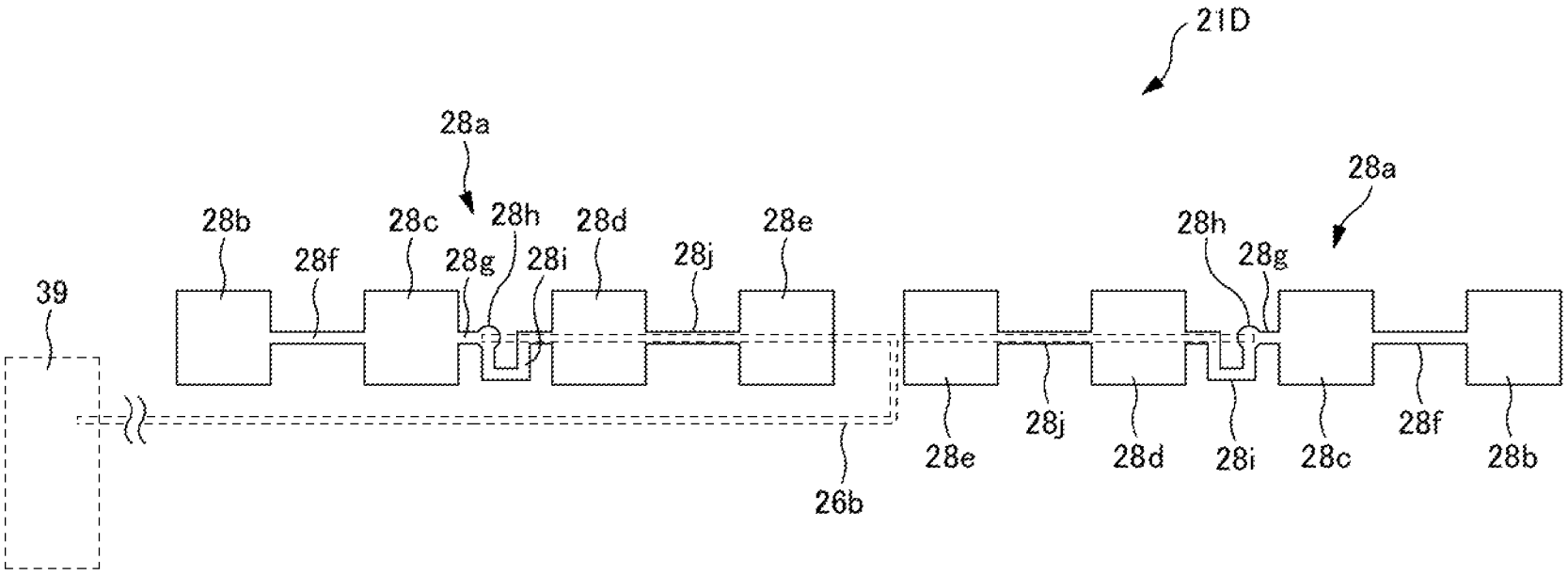
FIG. 13 is a plan view of an antenna according to a fourth embodiment.

FIG. 13 is a plan view of an antenna 21D according to a fourth embodiment. Hereinafter, differences between the antenna 21D in the fourth embodiment and the antenna 21C in the third embodiment will be described, and description of common matters will be omitted.

In the antenna 21C in the third embodiment, one of the element rows 28*a* has a shape obtained by moving the other of the element rows 28*a* in parallel in the row direction. In contrast, in the antenna 21D in the fourth embodiment, the one element row 28*a* has a shape that is line symmetric with the shape of the other element row 28*a* with respect to a symmetric line orthogonal to the row direction of the other element row 28*a*. Radiation elements 28*e* to 28*b* in the other element row 28*a* are linearly arranged in line at intervals in the order of the radiation elements 28*e*, 28*d*, 28*c*, and 28*b*, following a tail-end radiation element 28*e* in the one element row 28*a*. Accordingly, the radiation elements 28*b* to 28*e* in these element rows 28*a* are linearly arranged.

A difference between an electrical length from a terminal of an RFIC 39 to a land part 28*h* in the one element row 28*a* along a feed line 26*b* and an electrical length from the terminal of the RFIC 39 to a land part 28*h* in the other element row 28*a* along the feed line 26*b* is equal to a half of an effective wavelength at the center of a band to be used.

Fifth Embodiment

Figure 14:
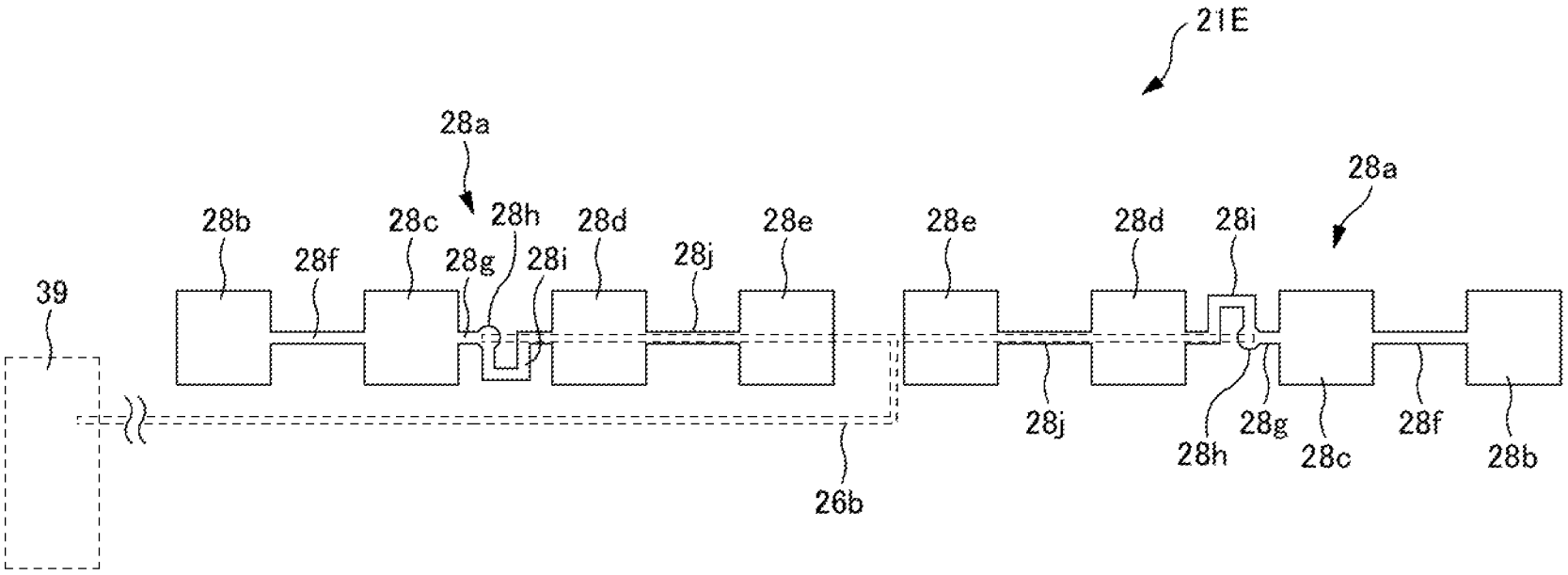
FIG. 14 is a plan view of an antenna according to a fifth embodiment.

FIG. 14 is a plan view of an antenna 21F according to a fifth embodiment. Hereinafter, differences between the antenna 21F in the fifth embodiment and the antenna 21C in the third embodiment will be described, and description of common matters will be omitted.

In the antenna 21C in the third embodiment, the one element row 28*a* has a shape obtained by moving the other element row 28*a* in parallel in the row direction. In contrast, in the antenna 21F in the fifth embodiment, one of element rows 28*a* and the other of element row 28*a* have point symmetry. Radiation elements 28*e* to 28*b* in the other element row 28*a* are linearly arranged in line at intervals in the order of the radiation elements 28*e*, 28*d*, 28*c*, and 28*b*, following a tail-end radiation element 28*e* in the one element row 28*a*. Accordingly, the radiation elements 28*b* to 28*e* in these element rows 28*a* are linearly arranged.

A difference between an electrical length from a terminal of an RFIC 39 to a land part 28*h* in the one element row 28*a* along a feed line 26*b* and an electrical length from the terminal of the RFIC 39 to a land part 28*h* in the other element row 28*a* along the feed line 26*b* is equal to a half of an effective wavelength at the center of a band to be used.

Modification Examples of Third to Fifth Embodiments

The modifications in the first embodiment may be applied to the third to fifth embodiments as in (1) to (4) below.

(1) The dielectric laminate 22 and the dielectric substrate 25 may be bonded together with an adhesive layer of a dielectric.

(2) The second dielectric layer 24 may be a laminate of a plurality of flexible dielectric layers.

(3) A protective dielectric layer may be formed on the surface of the first dielectric layer 23 so as to coat the conductive pattern layer 26.

(4) The two branched end parts of the feed line 26*b* may be electromagnetically coupled to the land parts 28*h* in the two element rows 28*a* through the slots 27*a*, respectively, without forming through holes in the dielectric layers 23 and 24.

Figure 15:
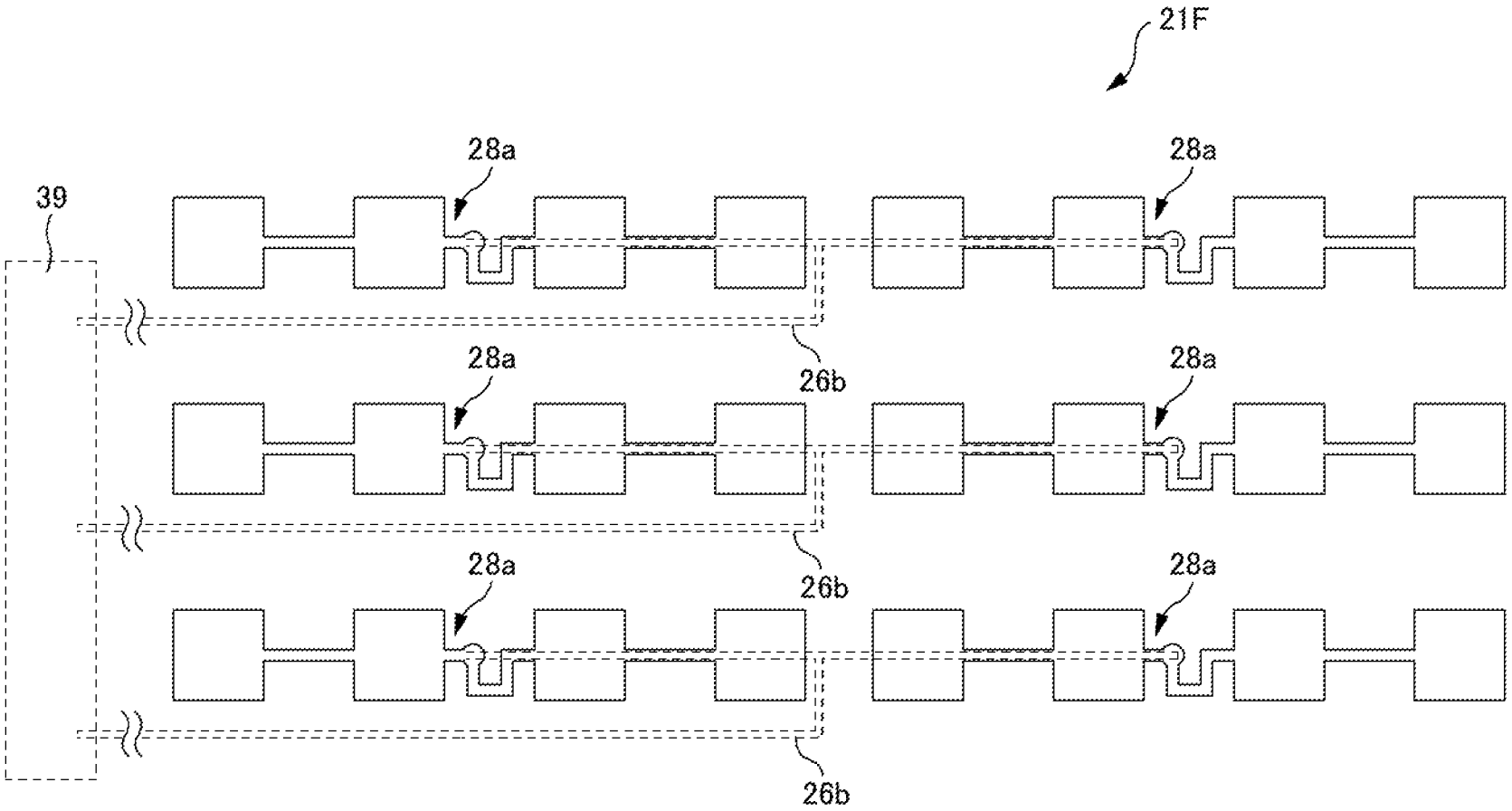
FIG. 15 is a plan view of an antenna according to a modification example of a third embodiment.

As in an antenna 21F in a modification example illustrated in a plan view of FIG. 15, sets each including the two element rows 28*a*, the feed line 26*b*, the slot 27*a* (see. FIG. 7), and the through hole 29 (see. FIG. 7) may be arranged in a direction orthogonal to the row direction of the element row 28*a* at predetermined pitches (e.g., 2 to 2.5 mm). In this case, radiation elements positioned in the same order and the same position, when counting from the leading end of the two element rows 28*a* in each of the sets, are aligned in the row direction, and the radiation elements are arranged in line in the direction orthogonal to the row direction.

FIG. 15 is a plan view of the antenna 21F in the modification example of the third embodiment. In modification examples of the fourth and fifth embodiments as well, sets each including the two element rows 28*a*, the feed line 26*b*, the slot 27*a* (see. FIG. 7), and the through hole 29 (see. FIG. 7) may be arranged at a predetermined pitch (e.g., 2 to 2.5 mm) in the direction orthogonal to the row direction of the element row 28*a*, similarly to the modification example of the third embodiment.

Two groups may be provided, each of which (see. FIG. 15) includes a plurality of sets (e.g., 16 sets) each including the two element rows 28*a*, the feed line 26*b*, the slot 27*a* (see. FIG. 7), and the through hole 29 (see. FIG. 7). The row directions of the element rows 28*a* in all of the groups are parallel to each other.

REFERENCE SIGNS LIST

1, 1A, 1B, 1C, 1D: Antenna;
21, 21A, 21B, 21C, 21D, 21E, 21F: Antenna;
3, 23: First dielectric layer;
4, 24: Second dielectric layer;
4*a*, 4*b*, 4*c*, 4*d*: Dielectric layer;
5, 25: Dielectric substrate;
6, 26: Conductive pattern layer;
6*a*, 26*a*, 26*b*: Feed line;
7, 27: Conductive ground layer;
7*a*, 27*a*: Slot;
8, 28: Antenna pattern layer;
8*a*, 28*b*, 28*c*, 28*d*, 28*e*: Radiation element;
28*a*: Element row;
38: Group.

The invention claimed is:

1. An antenna comprising:

a first dielectric layer;

a conductive pattern layer formed on a surface of the first dielectric layer;

a second dielectric layer joined to the first dielectric layer on a side opposite to the conductive pattern layer with respect to the first dielectric layer;

a conductive ground layer formed between the first dielectric layer and the second dielectric layer;

a dielectric substrate joined to the second dielectric layer on a side opposite to the conductive ground layer with respect to the second dielectric layer; and an antenna pattern layer formed between the second dielectric layer and the dielectric substrate, the antenna pattern layer including one or more radiation elements, the conductive pattern layer including a feed line for supplying electric power to the radiation elements, the first and second dielectric layers being flexible, the dielectric substrate being rigid.

2. The antenna according to claim 1, wherein a thickness of the dielectric substrate is 300 to 700 μm.

3. The antenna according to claim 1, wherein a sum of thicknesses of the first and second dielectric layers is equal to or less than 250 μm.

4. The antenna according to claim 1, wherein four, six, or eight of the radiation elements are linearly arranged at intervals and connected in series, and electric power is supplied through the feed line to the center of a row of the radiation elements.

5. The antenna according to claim 4, wherein two rows of the radiation elements are linearly arranged in line, and one of the radiation element rows has a shape that is line symmetric or point symmetric with a shape of another of the radiation element rows, or has a shape obtained by moving the other radiation element row in parallel.

6. The antenna according to claim 4, wherein a plurality of the radiation element rows are arranged at a predetermined pitch in a direction orthogonal to a direction of the radiation element rows, and radiation elements positioned in the same order in the radiation element rows are arranged in line in the orthogonal direction.

7. The antenna according to claim 6, wherein the predetermined pitch is 2 to 2.5 mm.

8. The antenna according to claim 6, wherein a plurality of groups are provided, the groups each including the plurality of radiation element rows arranged at the predetermined pitch in the direction orthogonal to the direction of the radiation element rows, and directions of the radiation element rows in all of the groups are parallel to each other.

9. The antenna according to claim 1, further comprising an adhesive layer of a dielectric formed between the second dielectric layer and the dielectric substrate so as to coat the radiation elements, to bond the second dielectric layer and the dielectric substrate together, wherein the adhesive layer is thicker than the radiation elements and thinner than the dielectric substrate.

10. The antenna according to claim 1, wherein the second dielectric layer is a laminate obtained by laminating a plurality of dielectric layers.

* * * * *